US006804903B1

(12) United States Patent
Cooper

(10) Patent No.: US 6,804,903 B1
(45) Date of Patent: Oct. 19, 2004

(54) EXCAVATOR WITH TRENCHING ATTACHMENT

(75) Inventor: Mark Cooper, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 21 days.

(21) Appl. No.: 10/420,245

(22) Filed: Apr. 22, 2003

(51) Int. Cl.[7] ..... E02F 5/04; E02F 3/14

(52) U.S. Cl. ..... 37/352; 37/465; 37/408; 37/410

(58) Field of Search ..... 37/352, 403, 468, 37/409, 410, 462, 464, 465

(56) References Cited

U.S. PATENT DOCUMENTS

| | | | | | |
|---|---|---|---|---|---|
| 3,042,236 | A | * | 7/1962 | Pilch | 74/105 |
| 3,099,098 | A | * | 7/1963 | Davis | 37/403 |
| 3,603,010 | A | * | 9/1971 | Polinek | 37/353 |
| 3,710,472 | A | * | 1/1973 | Gremillion et al. | 29/891 |
| 3,911,602 | A | * | 10/1975 | Trevathan | 37/348 |
| 4,222,186 | A | * | 9/1980 | Molby | 37/410 |
| 4,526,425 | A | * | 7/1985 | Schroeder | 301/36.1 |
| 5,237,888 | A | * | 8/1993 | McCombs | 74/491 |
| 5,970,634 | A | * | 10/1999 | Dann et al. | 37/301 |
| 6,351,900 | B1 | * | 3/2002 | DeWind | 37/362 |

FOREIGN PATENT DOCUMENTS

| | | | |
|---|---|---|---|
| JP | 55-52439 | * | 4/1980 |
| JP | 56-73732 | * | 6/1981 |
| JP | 6121239 | * | 1/1986 |

* cited by examiner

*Primary Examiner*—Thomas B. Will
*Assistant Examiner*—Thomas A Beach
(74) *Attorney, Agent, or Firm*—Sturm & Fix LLP

(57) ABSTRACT

An undercarriage having tracks or the like is attached thereto is provided for moving the undercarriage along the ground. A turret is attached to the undercarriage along a first substantially vertical axis so that the turret can rotate. A backhoe is pivotally attached to the turret along a second substantially vertical axis. A trencher is operatively attached to the turret and occupies an area adjacent the undercarriage. Structure is provided for preventing the backhoe from moving into an area occupied by the trencher.

12 Claims, 12 Drawing Sheets

EXCAVATOR WITH TRENCHING ATTACHMENT

STATEMENT REGARDING FEDERALLY SPONSORED RESEARCH OR DEVELOPMENT

Not Applicable

BACKGROUND OF THE INVENTION

The present invention relates to machines for excavating soils as necessary in construction projects. More specifically it relates to a machine that is adapted specifically for long narrow trenches and at the same time for more general excavations.

Long narrow trenches are required for installation of many utilities including water and sewer, gas, electrical power, and cable for communications. These utilities are often installed using machines known as trenchers, one example is illustrated in FIG. 1. A trencher 10 includes a trenching boom 40, with a boom frame 42 that supports an excavation chain 44 routed around and supported by end idler 46. The trenching boom 10 is mounted to a mobile chassis 12 capable of propelling the boom through the ground while the boom is lowered into the ground such that the end idler 46 is in a position to excavate to the desired depth. There are two basic types of chassis, a track chassis and a rubber tire chassis. FIG. 1 illustrates a rubber tire chassis, and that type of trencher is thus known as a rubber tire trencher.

Rubber tire trenchers have an advantage over track trenchers in that they are less disruptive to the ground. Thus, they are utilized in applications where maintaining the ground is important, such as when trenching through established yards. In this application the needed excavation varies widely. Thus, rubber tire trenchers typically include a variety of excavating attachments and can include a vibrating gearbox and mount for a plow on the rear of the machine beside the trenching boom, not shown, while including a backhoe 20 and blade 30 attached to the front of the rubber tire trencher 10.

While the rubber tire trencher offers great flexibility, its capability for general excavation with the backhoe 20 is somewhat limited by the chassis. The backhoe can be positioned around its pivot axis 22 while being controlled by an operator positioned in operator station 14. Any additional movement of the backhoe requires movement of the entire chassis.

Different machines have been developed for general excavation, and are generally known as Excavators, an example being a compact excavator 110 as illustrated in FIG. 2. The compact excavator 110 has evolved to include two basic parts, an undercarriage or chassis 112 and turret/turntable 116. The undercarriage 112 includes the chassis and typically tracks. It supports the turret/turntable 116 and typically also supports a backfill blade 130, which is positioned with cylinder 132.

The upper structure, turret or turntable 116 includes the power unit, typically a diesel engine and hydraulic system, the operator's station 114, and a backhoe 120 mounted on a pivot 122. There is no limitation of the rotation of the turntable, it is able to rotate fully, mounted to the undercarriage 112 at the swivel joint, supported by a slew bearing. The swivel joint supports the turret 116 and further provides a valve to provide a flow path for oil to be transferred from the pump, a component of the power unit, to the track drive motors and cylinder that positions the backfill blade 130. This valve is constructed to allow the turret to rotate freely.

The operator's station 114 is mounted on the turret 116, and the pivot for the backhoe 122 is positioned directly in front of the operator's station. This arrangement provides good visibility of the backhoe 120, and provides for flexibility in applications. Examples of this flexibility are illustrated in FIG. 3 where the excavator 110 is shown digging near to an existing wall 2. In these illustrations it can be seen how the chassis 112 can be positioned near the wall 2, the turret 116 rotated such that the backhoe pivot 122 is adjacent the wall, and the backhoe 120 positioned parallel to the wall. As positioned, the bucket can scoop in a direction parallel to the wall to form trench 4. Once the bucket is full it can be lifted, and the backhoe 120 rotated in order to position the backhoe and bucket to a second position 120*a*, away from the wall, to drop the excavated material in a pile or into a truck.

Excavators have become a preferred arrangement for general excavation. However, when a job involves specifically forming a trench of a specific depth and width, this arrangement is not as productive as the trenching boom described earlier as a part of the rubber tire trencher, particularly when the trench is narrow.

FIG. 4 illustrates the use of a compact excavator 110, positioned in four different locations 110*a*, 110*d*, 110*c*, and 110*d*, as would be necessary to dig a trench. The compact excavator is operated in the first position 110*a*, while the backhoe 120 is utilized to dig a first section of the trench. After completion, the chassis is moved to a second position 110*b*, and the trench extended. This process is repeated 110*c*, and 110*d* until the trench is the desired length. This process requires a substantial amount of operator involvement.

By contrast, the rubber tire trencher is illustrated in FIG. 1 will require less operator involvement. This involvement includes first controlling the trenching boom 40 during a plunge-cut, as the boom is rotated clockwise to move the end idler 46 from a position above the ground, to a position where a trench of the desired depth is being formed. Subsequent operator control then involves adjusting the ground speed of the rubber tire trencher 10 to match the excavation capacity of the trenching boom 40.

Trenchers have not previously been installed onto compact excavators.

BRIEF SUMMARY OF THE INVENTION

According to the present invention there is provided a modification to a compact excavator by adding an optional component, a chain trencher.

A broad object of the present invention is to provide an excavator with a trencher.

Another object of the present invention is to provide an excavator with a trencher in a way that will automatically prevent a backhoe portion of the excavator from coming in contact with the trencher.

Still another object of the invention is to employ such an excavator with a trencher in a way that will automatically prevent a backhoe portion of the excavator from coming in contact with the trencher, but also use a mounting structure for the backhoe which allows the backhoe to move around 360 degrees once the mounting structure and trencher is removed.

Other objects, advantages, and novel features of the present invention will become apparent from the following detailed description of the invention in conjunction with the accompanying drawings.

DETAILED DESCRIPTION OF THE INVENTION

Figure 1:
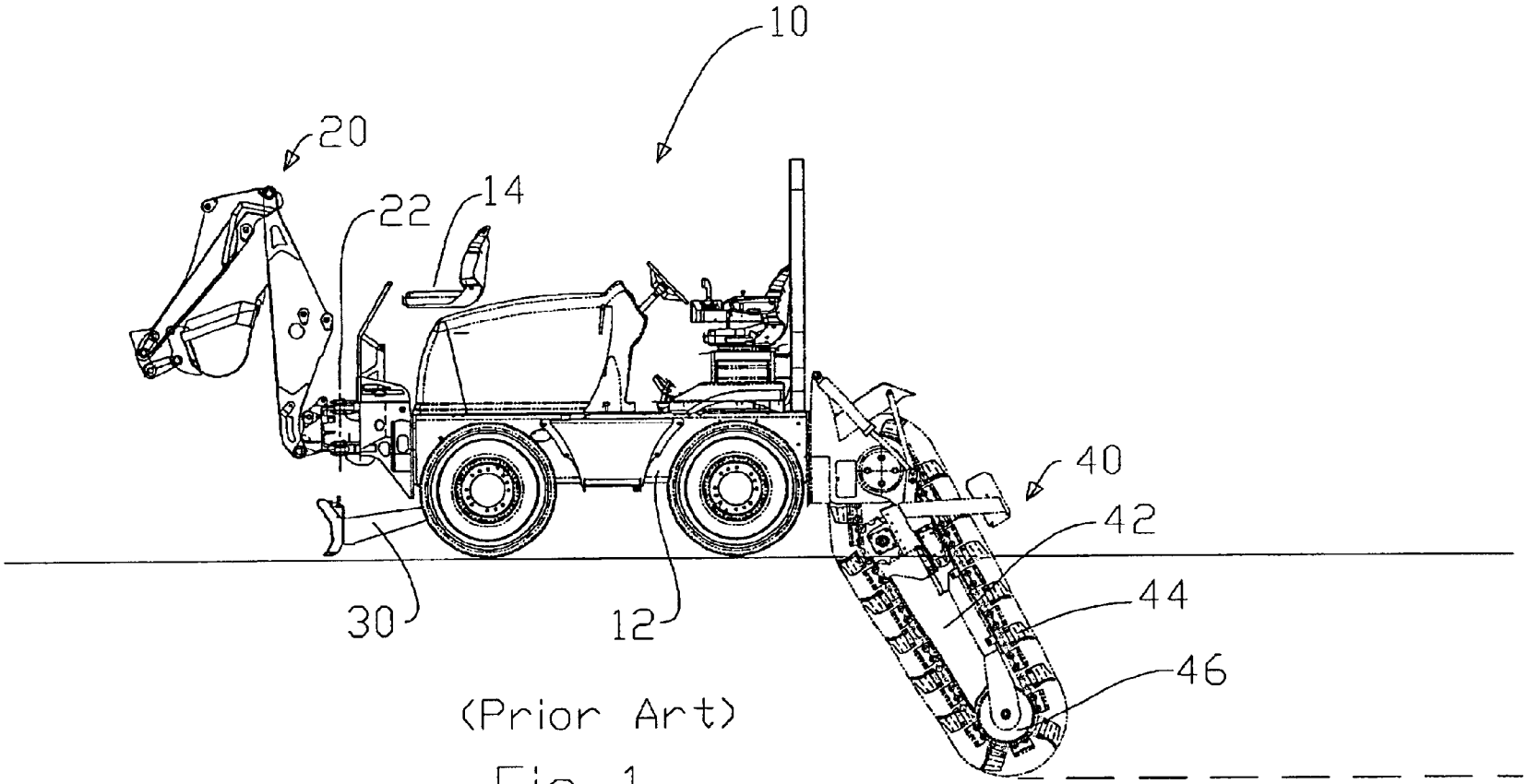
(Prior Art) Fig 1
FIG. 1 is a side view of prior art machine adapted for digging a trench known as a rubber tire trencher.
Figure 2:
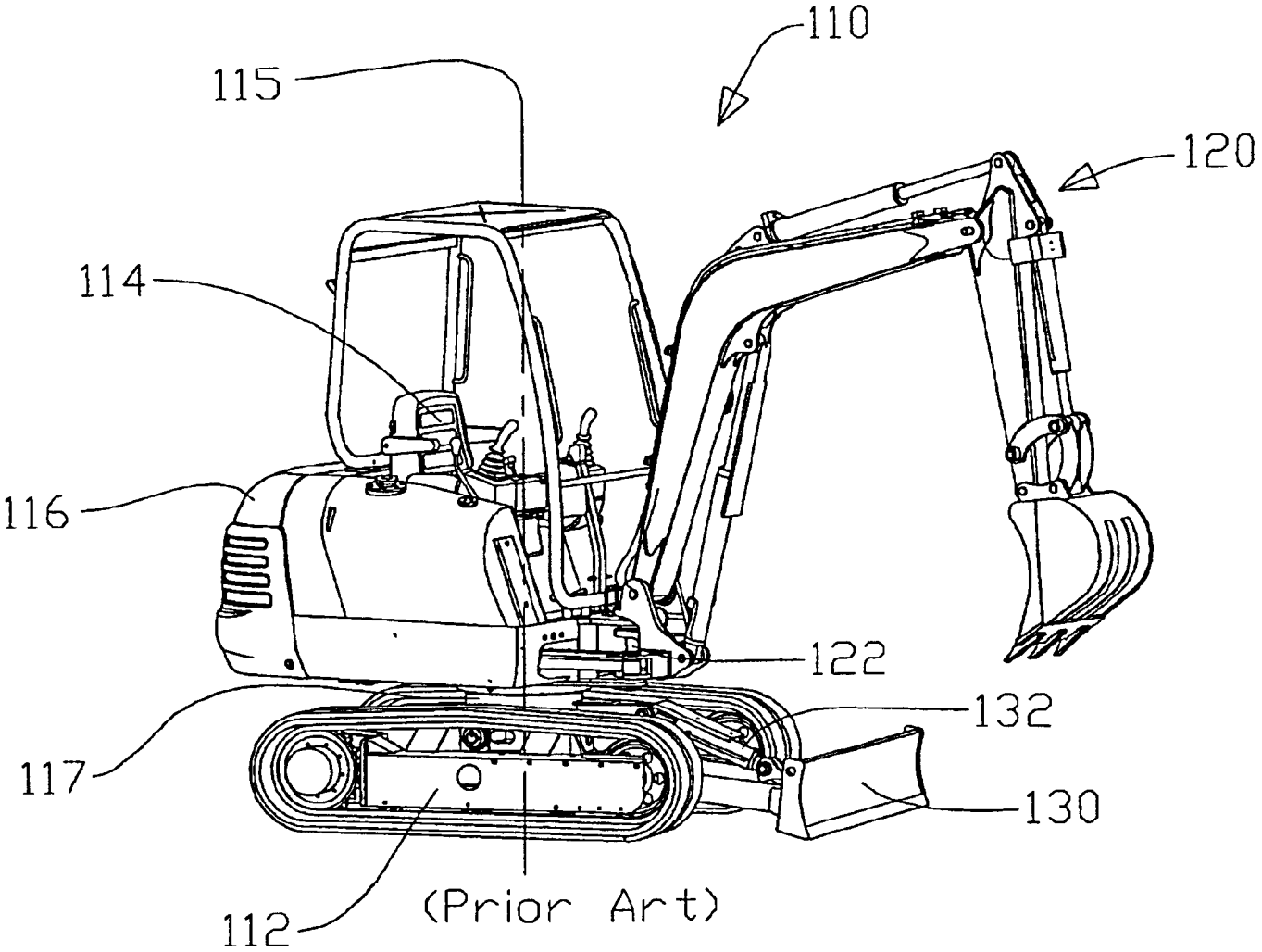
(Prior Art) Fig 2
FIG. 2 is an isometric view of prior art machine adapted for general excavation known as a compact excavator.
Figure 3:
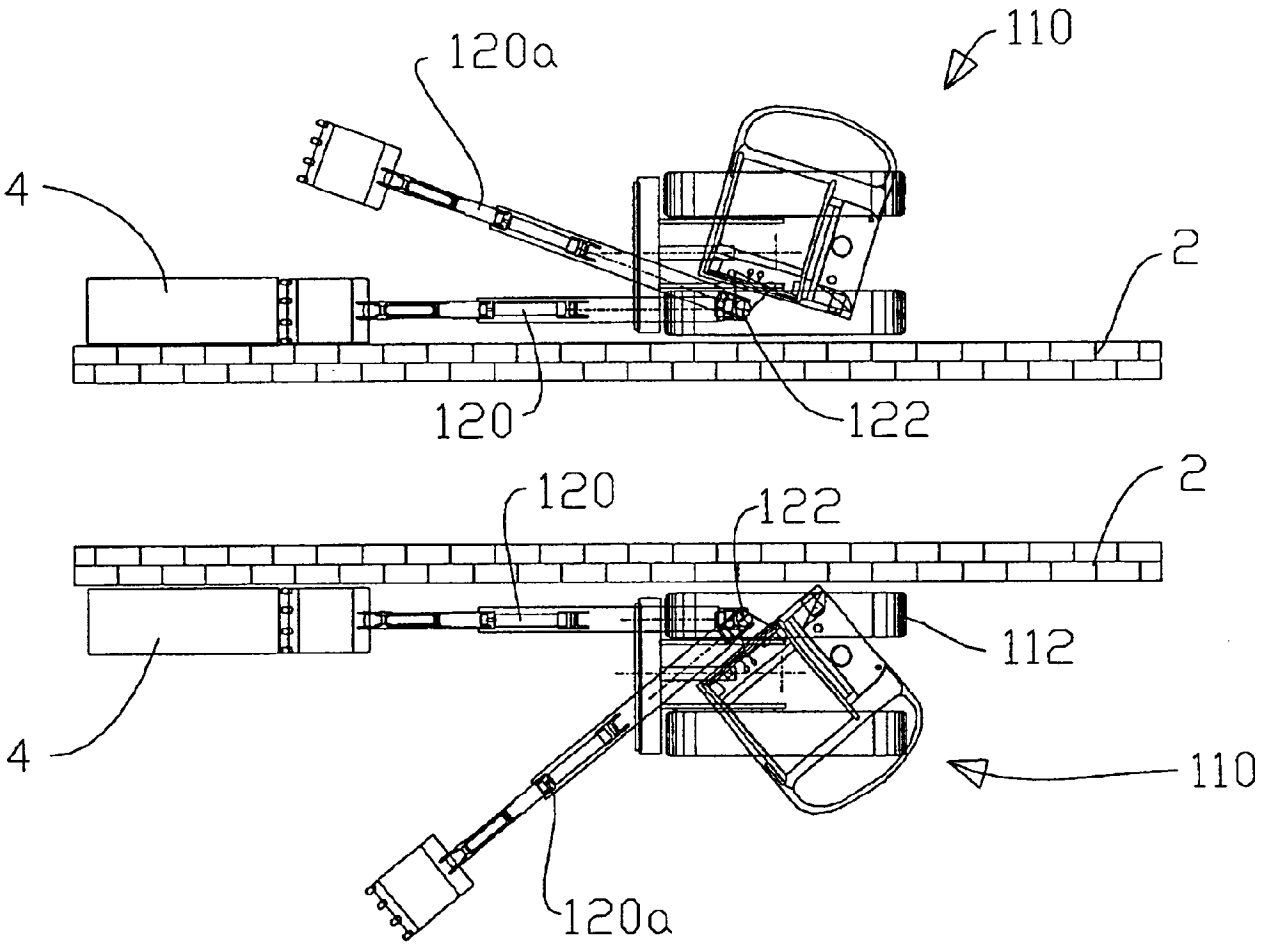
(Prior Art) Fig 3
FIG. 3 is a top view of a prior art compact excavator illustrating the digging boom in various positions.
Figure 4:
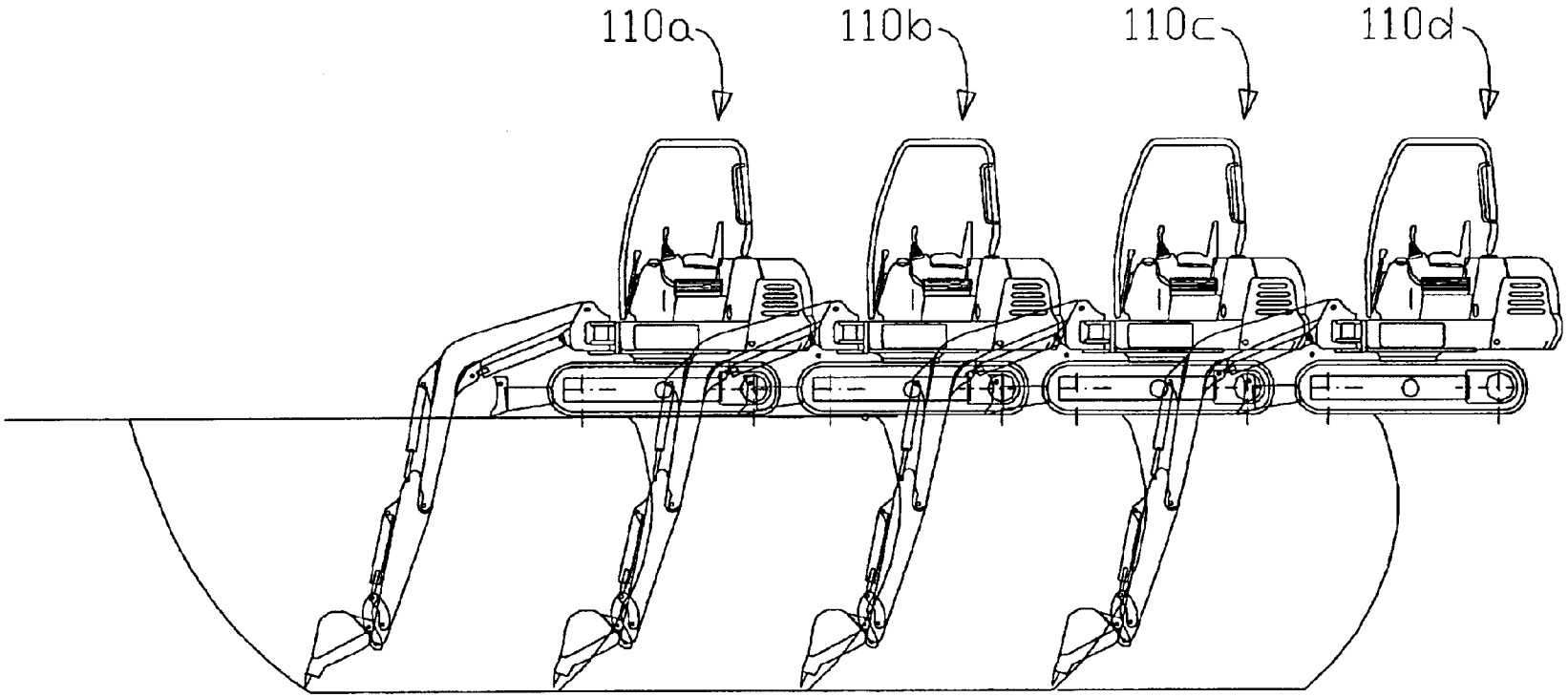
(Prior Art) Fig 4
FIG. 4 is a side view of a prior art compact excavator illustrating the process of digging a trench.

Referring now to the drawings, like reference numerals designate identical or corresponding parts throughout the several views. The included drawings reflect the current preferred and alternate embodiments. There are many additional embodiments that may utilize the present invention. The drawings are not meant to include all such possible embodiments.

Figure 5:
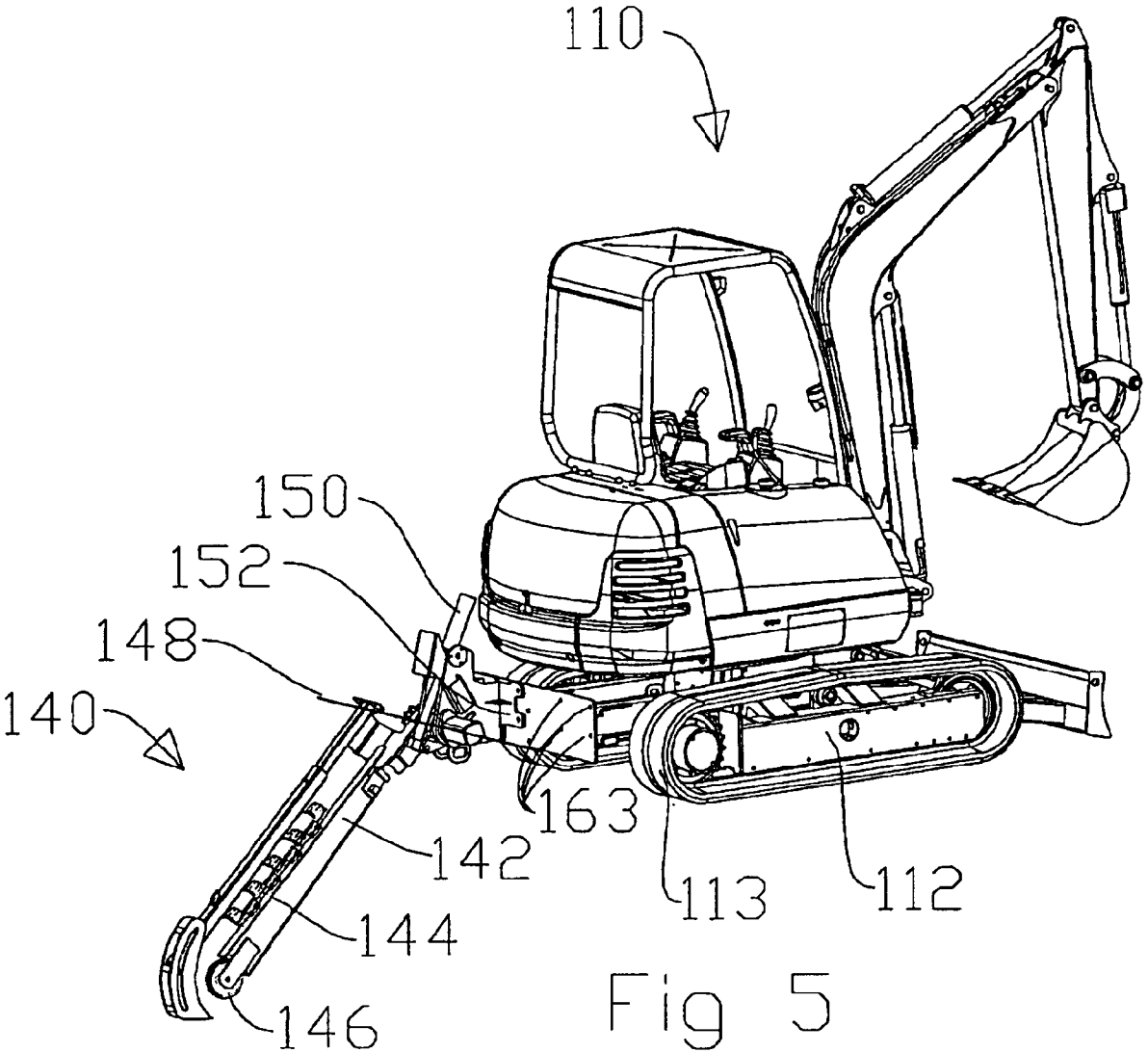
FIG. 5 is an isometric view of the compact excavator of the present invention including a trenching boom.

FIG. 5 illustrates a preferred embodiment of the present invention, a compact excavator 110 with a trenching boom 140 attached to the undercarriage 112, supported on tracks 113. The trenching boom 140 includes boom frame 142, excavating chain 144, and end idler 146. The trenching boom 140 will function in a manner identical to that described for the rubber tire trencher of FIG. 1, including the ability to pivot about axis 148 between a lowered position, as illustrated, and a raised position. In the lowered position, the end idler 146 has been lowered to position the excavating chain 144 to form a trench of the desired depth. During the excavation process, the excavating chain 144 engages the ground while the boom frame 142 forces it into this engagement with a down-force sufficient to make the excavation efficient. The boom frame 142 is positioned by cylinder 150 which transfers a portion of the overall weight of the compact excavator 110 from the tracks 113 to the boom frame 142. This weight transfer is optimized by keeping the pivot 148 of boom frame 142 near to the center of gravity of the compact excavator 110.

Figure 6:
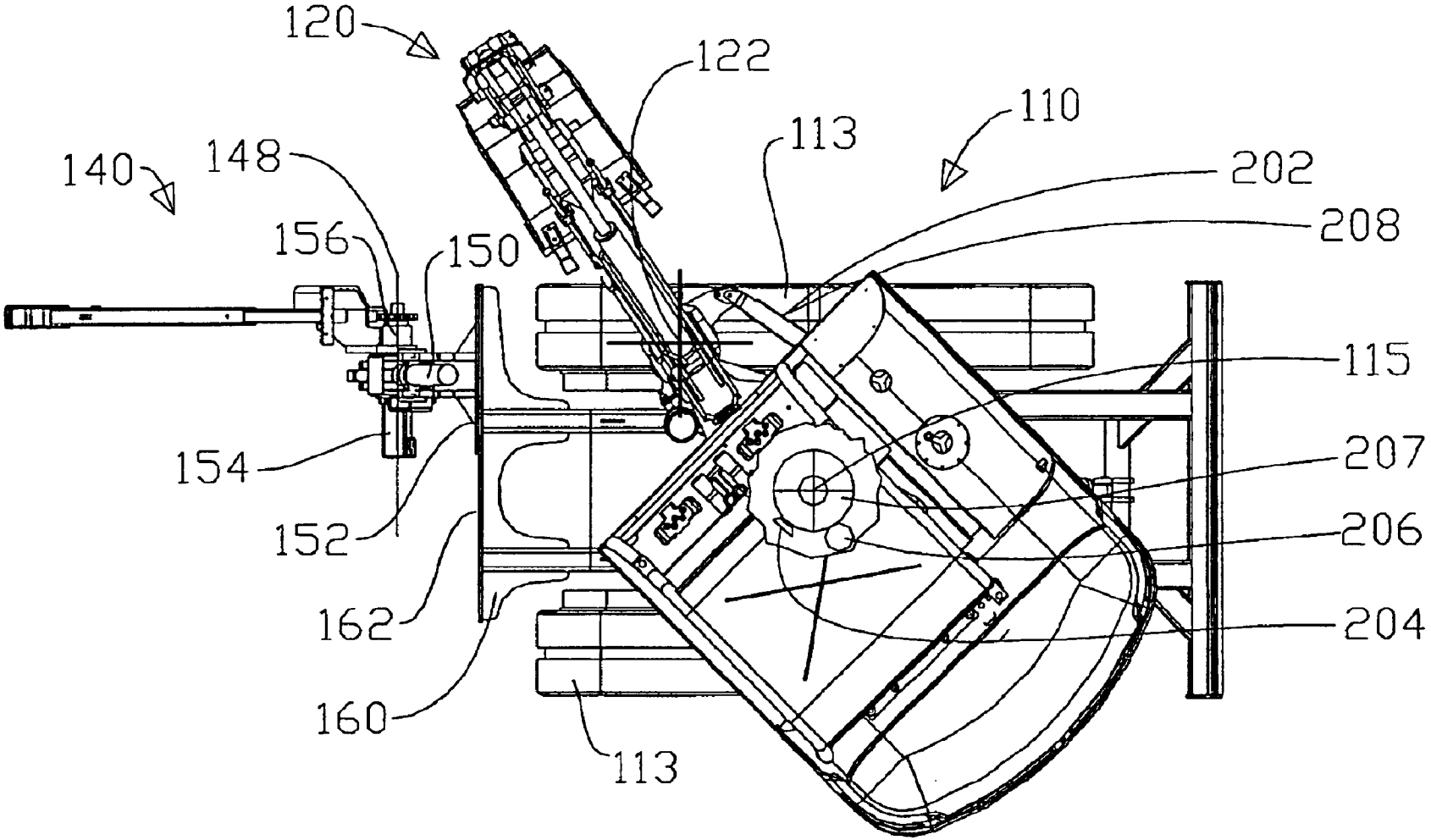
FIG. 6 is a top view of a compact excavator of the present invention including a trenching boom with portions cutaway to show some of the components of the alternate embodiment shown schematically in FIG. 12.

FIG. 6 illustrates the mounting of the trenching boom 140 to the compact excavator 110. The mounting is accomplished with two main components including a trencher attachment frame 160 and trencher mount frame 152. The attachment frame or sub-frame 160 includes a trencher mounting pad 162 that is positioned in close proximity to the tracks 113, leaving clearance required for proper function of the tracks. The attachment frame or sub-frame 160 could have attachments other than the illustrated chain trencher, such as rock wheel trenchers, plows for installing utility lines, etc.

The trencher mounting pad 162 is configured to include a series of mounting holes 163, shown in FIG. 5, that allow the trencher mount frame 152 to attach in a number of different locations, in order to change the location of the trenching boom 140 relative to the tracks. The trencher-mount frame 152 further provides support for cylinder 150, for the rotational connection that defines pivot axis 148 and for the trencher motor 154. In this manner the trenching boom 140 is positioned such that a sufficient down-force can be generated to provide for efficient excavation.

In this FIG. 5 position, without the stop structure 118 and stop pads 168 described below, the backhoe 120 could contact the trenching boom 140, or its mounting components. Thus when the trenching boom 140 is mounted to the compact excavator the ability to freely rotate the turntable 116 will be restricted, as the backhoe 120, depending on where it is positioned relative to the turntable 116, may interfere with the trenching boom 140 or its mounting components.

The present invention places an attachment, a trenching boom 140, onto a compact excavator in a position where it limits the rotational travel of the turntable. The operator will be required to be aware of the position of the backhoe 120 whenever the turntable is rotated to avoid interference of the components.

Figure 7:
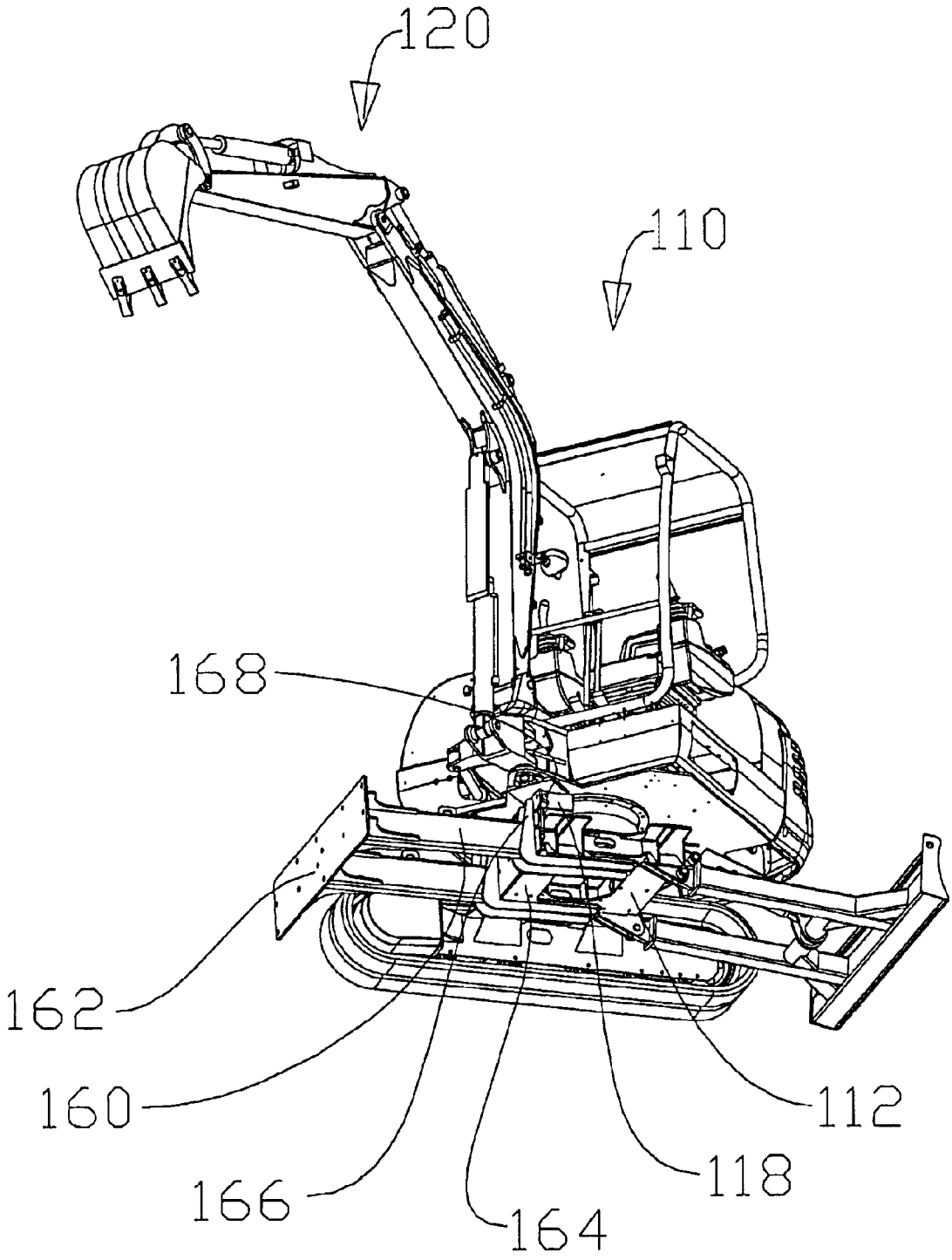
FIG. 7 is an isometric view from a low position and with one of the tracks removed and the trencher removed to expose the mounting structure for the trenching boom.
Figure 8:
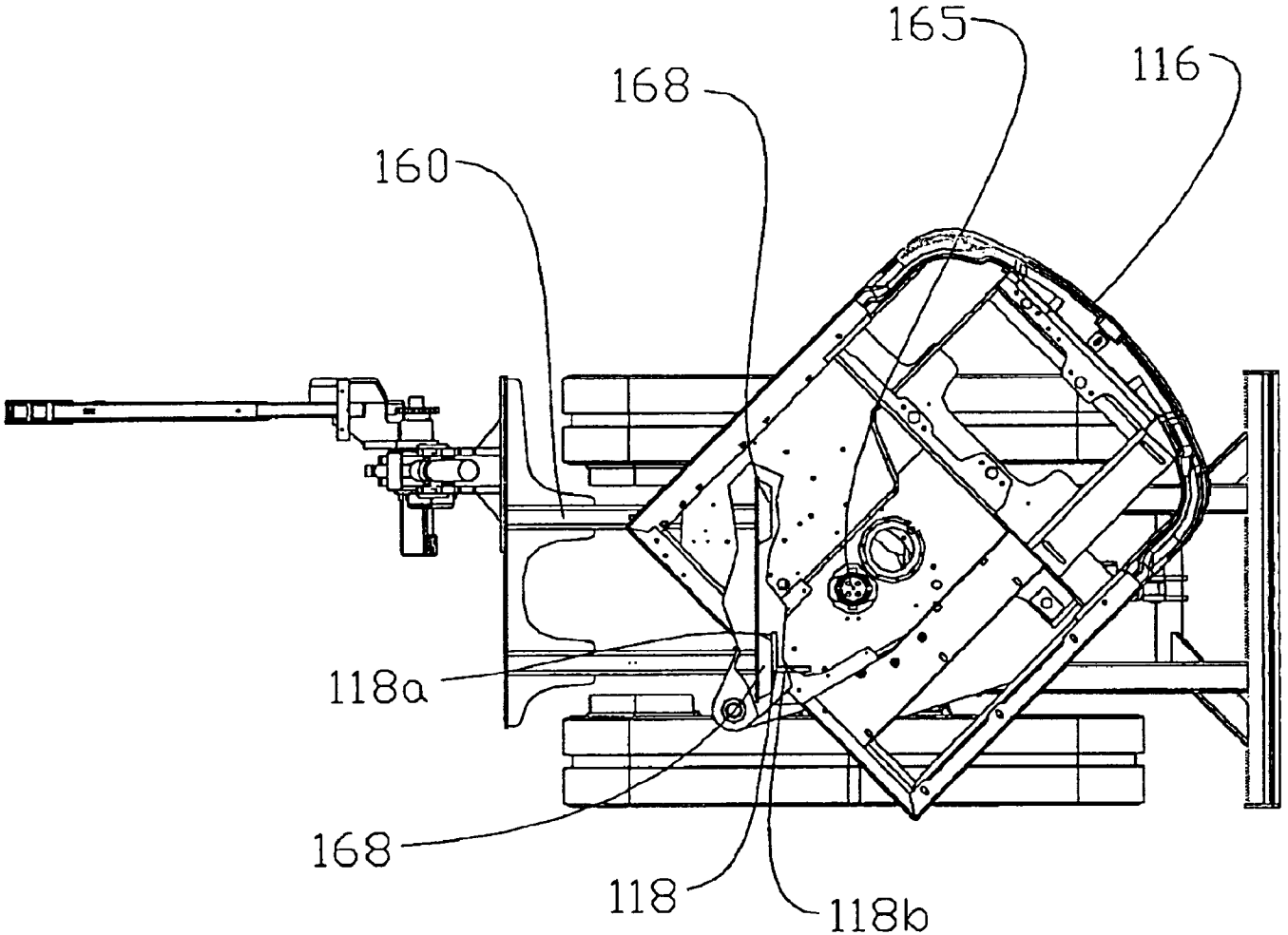
FIG. 8 is a top view with the trencher in the same position as illustrated in FIG. 6, with a portion of the turret cut-away to show a stop structure.
Figure 9:
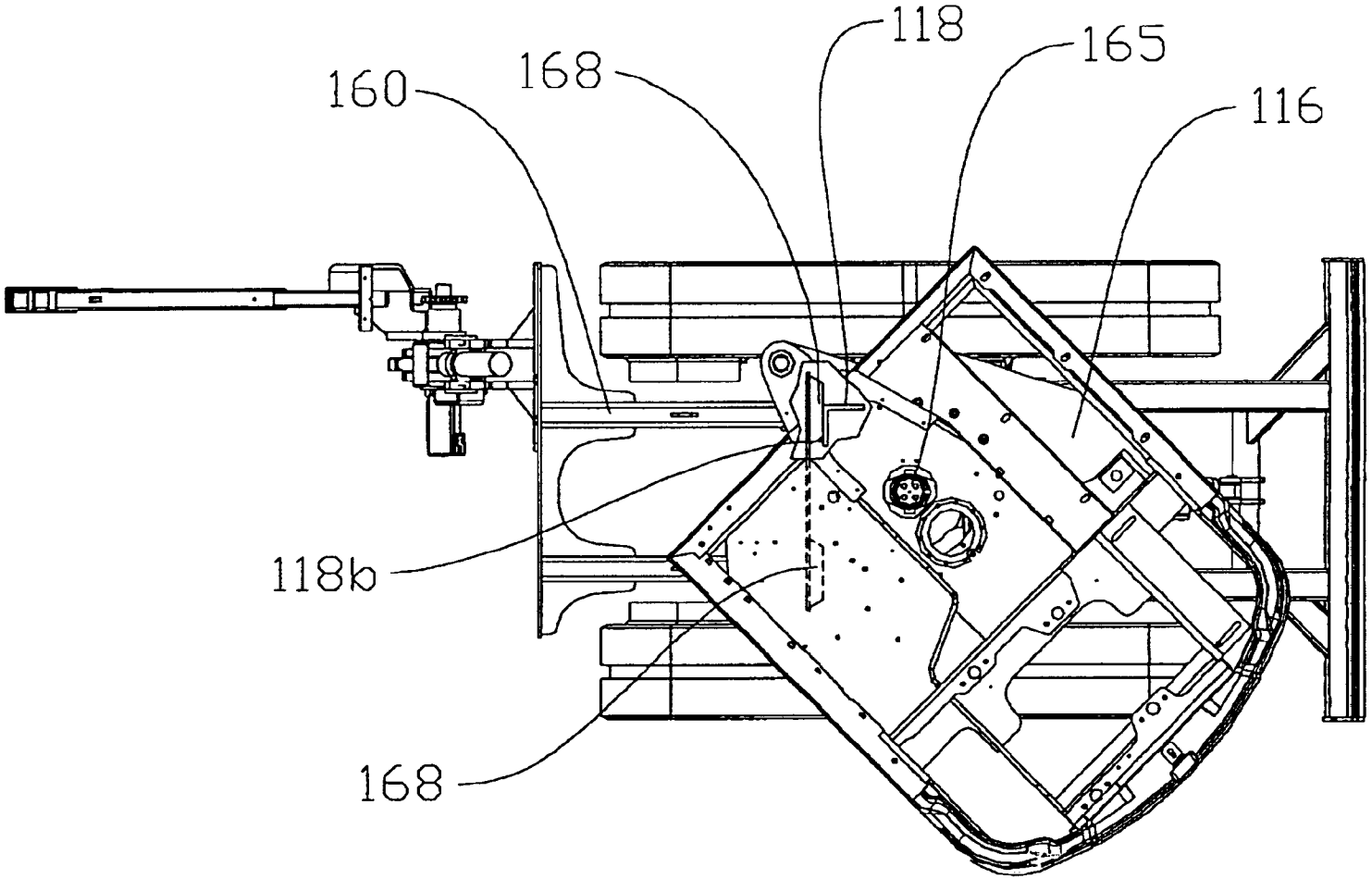
FIG. 9 is a view similar to FIG. 8 with the turntable rotated to the position where it is stopped against the second stop, with a portion of the turret cut-away to show a portion of a stop structure.
Figure 10:
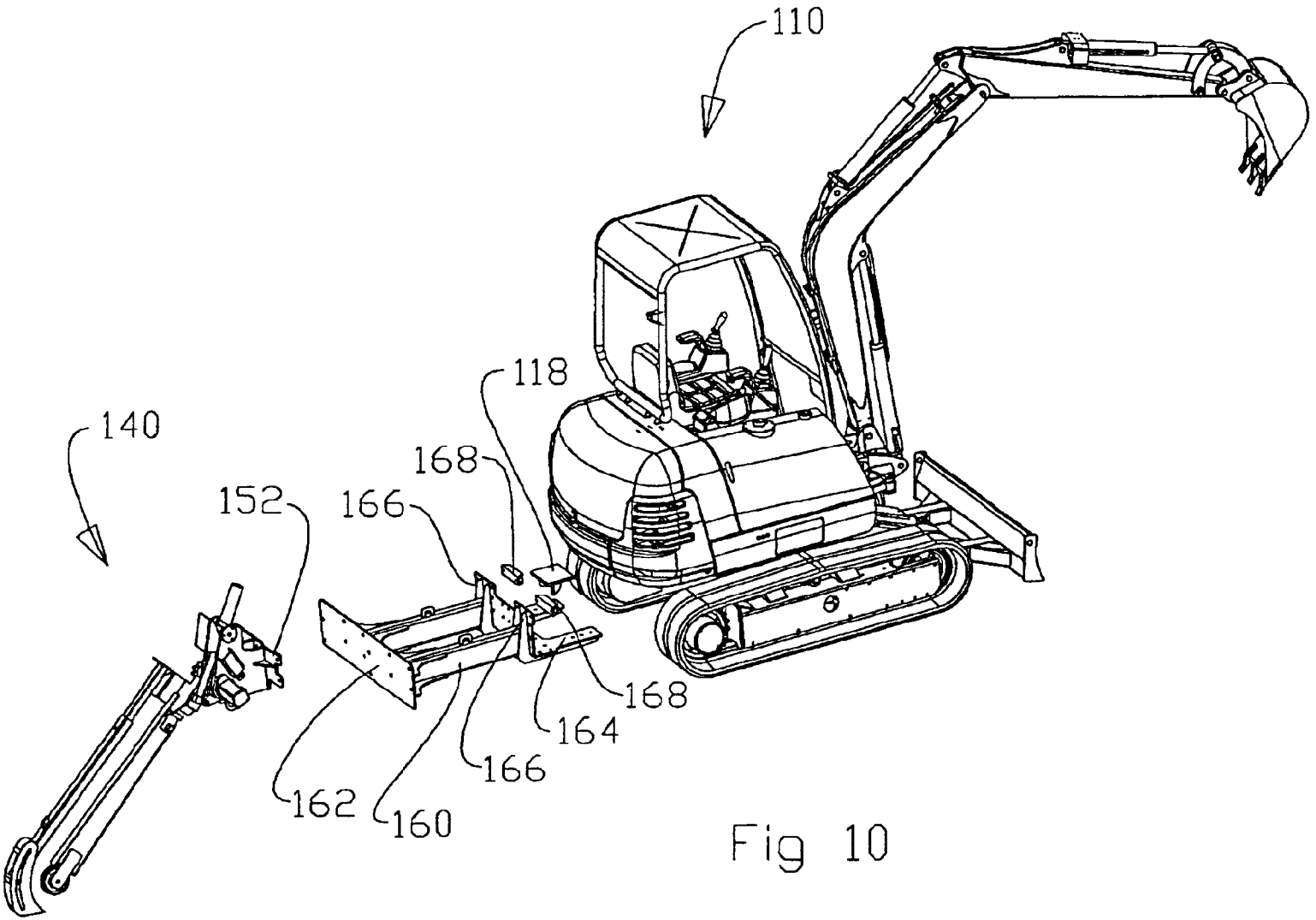
FIG. 10 is an exploded isometric view showing the compact excavator, the trencher boom mount and the trenching boom.

A further aspect of the present invention is to provide limits that will reduce the burden on the operator, by introducing an automatic limitation to reduce the probability of damage. A preferred embodiment is illustrated in FIGS. 7 and 10. The trencher attachment frame or sub frame 160 includes the trencher mounting pad 162 on a first end, and is adapted to attach to the undercarriage 112 on the opposite end with an adapter pad 164. It further includes stop arms 166 supporting stop pads 168 as shown in FIGS. 8–10. The trencher attachment frame or sub frame 160 is configured to be easily attached to the undercarriage 112 and can easily be removed when the trencher boom 140 will not be used. In this manner, when the trencher attachment frame or sub frame 160 is removed from the compact excavator 10, the stop pads 168 are also removed.

FIGS. 8 and 9 illustrate the function of the stop pads 168. In FIG. 8 the turntable 116 has been rotated clockwise to a position where a turntable stop bracket 118 has contacted the first stop pad 168. The turntable stop bracket 118 attaches to the turntable, extending from the bottom surface as shown in FIG. 7. Stop bracket 118 is a V-shaped bracket with a first surface 118*a* and a second surface 118*b*. In FIG. 8 surface 118*a* is illustrated in the cut-away section of the turntable 116 in contact with the first stop pad 168.

In FIG. 9, the turntable has been rotated counter-clockwise until the second surface 118*b* of turntable stop bracket 118 has contacted the second stop pad 168. In this manner, whenever the trencher attachment frame 160, including the stop pads 168, is mounted to the compact excavator 110, the rotation of the turntable 116 will be limited.

Figure 11:
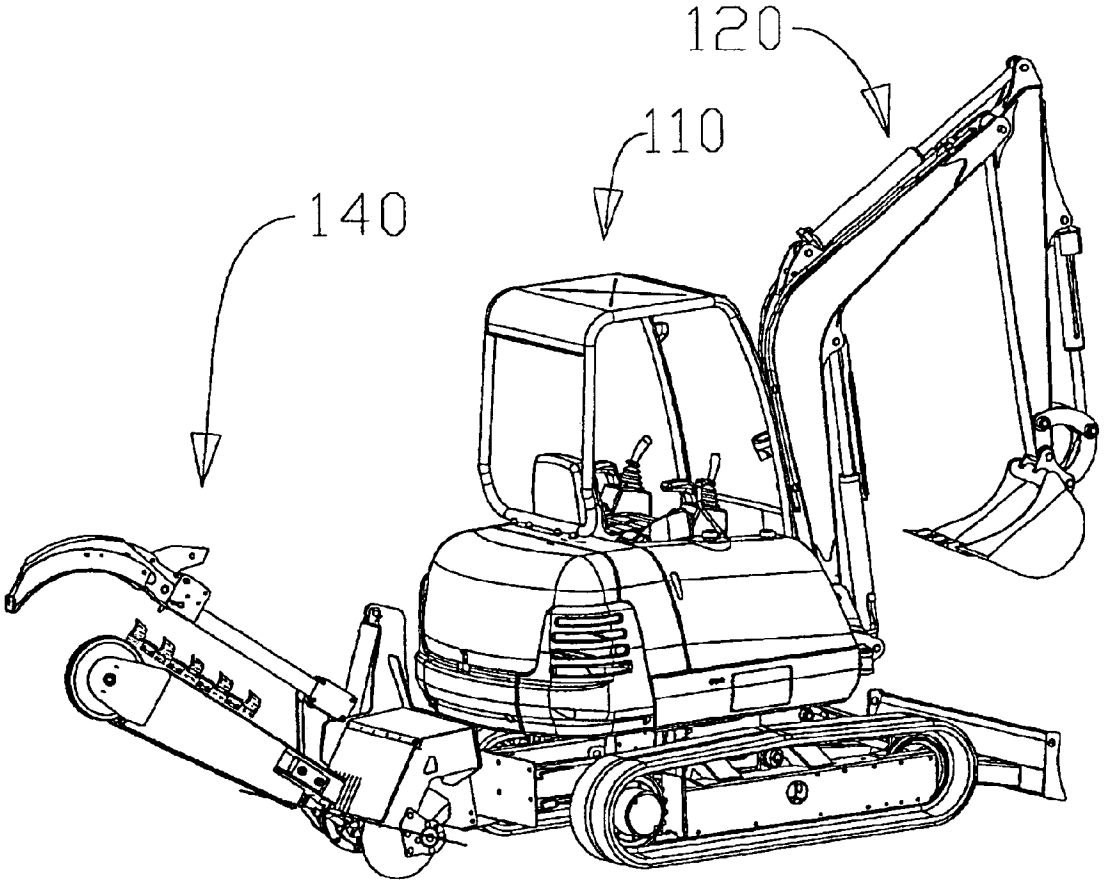
FIG. 11 is an isometric view showing the compact excavator, with the trenching boom raised into a transport position.

With this limitation, the backhoe 120 can still be positioned to interfere with the trenching boom 40, for instance if the boom were pivoted counterclockwise around its pivot 122 from the illustrated position in FIG. 6. However, when the backhoe 120 is centered, as illustrated in FIG. 6, the backhoe will not interfere. The potential for interference is higher when the trenching boom 140 is in a raised, transport position as illustrated in FIG. 11. However, with the compact excavator of the present invention, the operator has simply to position the backhoe in the center position, and then can be confident that there will not be any interference when rotating the turntable in order to operate the trenching boom.

FIG. 6 illustrates the mechanical elements that control the position of the backhoe, and of the turntable. The backhoe is positioned by a hydraulic cylinder 208, which is typically directly controlled by a joystick, actuated by the operator. The position the backhoe could be determined with a device 202 capable of measuring the linear travel of cylinder 208.

A rotary actuator, such as a hydraulic motor, positions the turntable which powers a gear 206 mounted onto the turntable that engages a gear 207 mounted onto the chassis. The position of the turntable can be determined, in a variety of methods, for example with a transducer 204 mounted by and actuated from the gears. In this example transducer 204 is mounted on the turntable such that it detects whenever it travels past a tooth of gear 207. By constantly monitoring this transducer, the position of the turntable can be continuously monitored. Another example would be to place transducer 204 on the turntable such that it detects certain targets mounted onto the chassis, such that it is possible to detect certain positions of the turntable.

Figure 12:
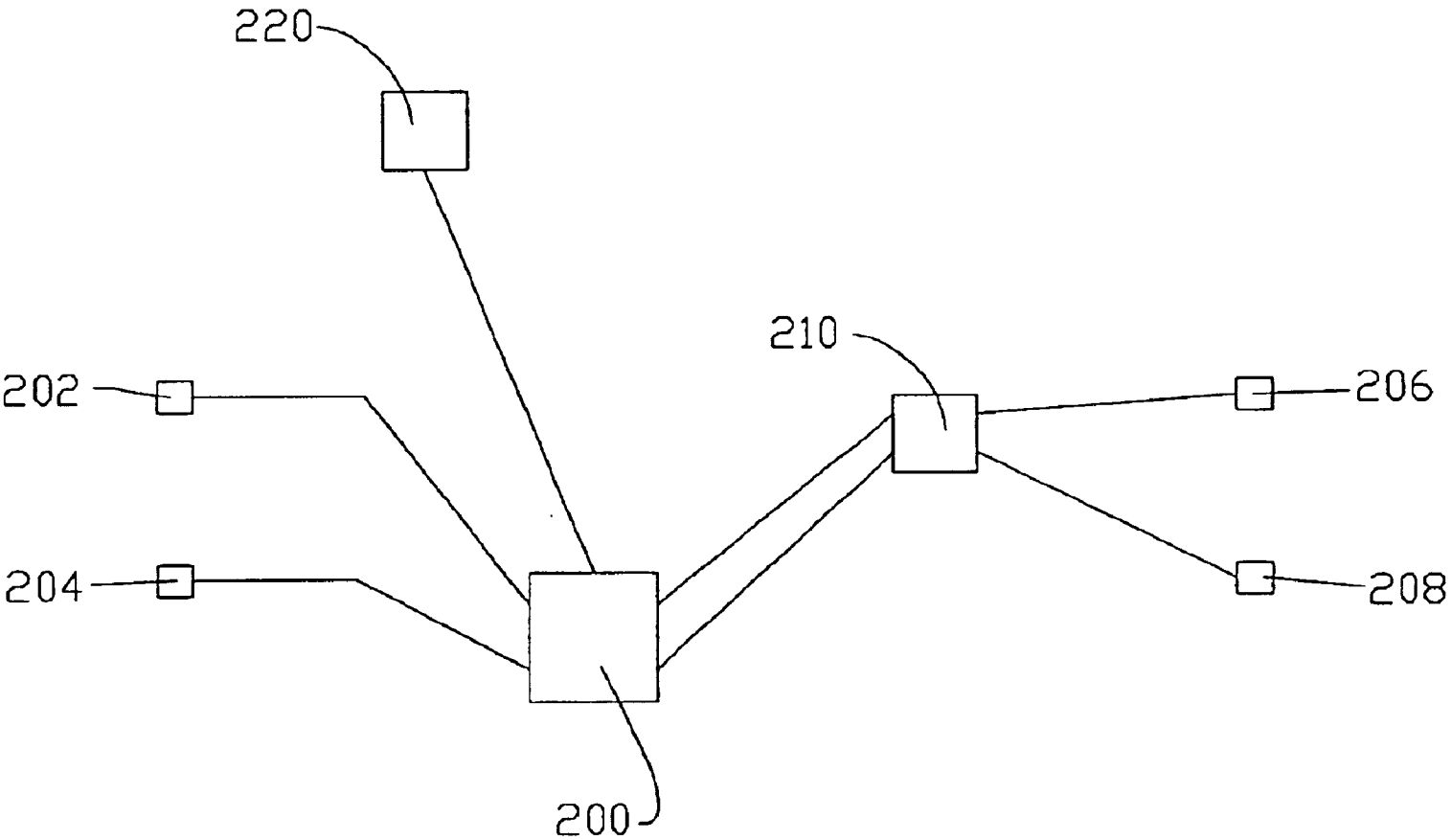
FIG. 12 is a schematic view of an alternate embodiment.

An alternative embodiment that would further reduce the burden on the operator is illustrated schematically in FIG. 12, and would incorporate an electronic controller 200 to control the stopped positions as a function of the position of the backhoe 120. The electronic controller 200 would be capable receiving inputs from transducers 202 and 204, described previously as detecting the position of the backhoe and the position of the turntable. It will further be capable of receiving inputs 220 from the operator. In response it will control valve 210, that controls hydraulic power to the cylinder 208 that positions the backhoe, and the hydraulic motor that rotates gear 206 to control the rotational position of the turntable. Controller 200 will include memory and computational capacity such that the turntable would be stopped at various positions, depending on where the operator had left the backhoe, as necessary to prevent interference between the backhoe and the trencher.

Controller 200 includes computational capacity such that the position of the backhoe will be controlled based on the position of the turntable. Thus, when the turntable is rotated such that the operator is in the vicinity of the trencher boom, the backhoe is prevented from being rotated around its axis into a position where it could interfere with the trencher boom.

Obviously many modifications and variations of the present invention are possible in light of the above teachings. It is therefore to be understood that, within the scope of the appended claims, the invention may be practiced otherwise than as specifically described.

I claim:

1. An excavator comprising:

(a) an undercarriage;

(b) a turret operatively attached to the undercarriage, said turret being capable of unlimited rotation around a substantially vertical axis;

(c) a backhoe operatively attached to said turret;

(d) a trencher operatively mounted to said undercarriage; and (e) a first component on the turret and a second component on the trencher wherein the first and second components cooperate to restrict the rotation of the turret such that the turret cannot rotate into a zone where the backhoe interferes with the trencher.

2. The excavator of claim 1 including means operatively attached to the undercarriage for selectively moving the undercarriage along the ground.

3. An apparatus comprising:

(a) an undercarriage;

(b) means operatively attached to said undercarriage for moving the undercarriage along the ground;

(c) a turret operatively rotatably attached to the undercarriage along a first substantially vertical axis;

(d) a backhoe operatively pivotally attached to the turret along a second substantially vertical axis;

(e) a trencher operatively attached to the undercarriage and occupying an area adjacent the undercarriage; and (f) means operatively attached to at least one of the turret and the undercarriage for automatically preventing the backhoe from moving into an area occupied by the trencher.

4. An excavator comprising:

(a) an undercarriage;

(b) a turret capable of unlimited rotation around a swivel axis defined in the undercarriage including a stop; and (c) a chain trencher including a trencher attachment frame for mounting to the undercarriage, the trencher attachment frame including at least one component that cooperates with said stop on the turret to restrict the rotation of the turret whenever the trencher is mounted to said excavator.

5. The excavator of claim 4 including means operatively attached to the undercarriage for selectively moving the undercarriage along the ground.

6. An excavator comprising:

(a) an undercarriage;

(b) a turret operatively attached to the undercarriage, said turret being capable of unlimited rotation around a substantially vertical axis;

(c) a backhoe operatively attached to said turret;

(d) a trencher operatively mounted to said undercarriage;

(e) a sub-frame selectively attached or detached from said undercarriage, said sub-frame having the trencher operatively attached thereto;

(f) a pair of stop members operatively attached to the sub-frame; and (g) a pair of stop brackets operatively attached to the turret for contact with respective ones of said stop members when the turret rotates, whereby the rotation of the turret is limited when the sub-frame is attached to the undercarriage.

7. The excavator of claim 6 wherein the stops and stop brackets are positioned for preventing the backhoe from contacting the trencher and the turret is rotated, at least at such times when the backhoe is centered.

8. The excavator of claim 7 wherein the turret can rotate 360 degrees when the sub-frame is removed from the undercarriage.

9. An excavator comprising:

(a) an undercarriage;

(b) a turret operatively attached to the undercarriage, said turret being capable of unlimited rotation around a substantially vertical axis;

(c) a backhoe operatively attached to said turret;

(d) a trencher operatively mounted to said undercarriage;

(e) a sub-frame selectively attached or detached from said undercarriage, said sub-frame having the trencher operatively attached thereto;

(f) at least one stop member operatively attached to the sub-frame; and (g) at least one stop brackets operatively attached to the turret for contact with at least one stop member when the turret rotates, whereby the rotation of the turret is limited when the sub-frame is attached to the undercarriage.

10. The excavator of claim 9 wherein the at least one stop and at least one stop bracket are positioned for preventing the backhoe from contacting the trencher and the turret is rotated, at least at such times when the backhoe is centered.

11. The excavator of claim 10 wherein the turret can rotate 360 degrees when the sub-frame is removed from the undercarriage.

12. An excavator comprising:

(a) an undercarriage;

(b) a turret operatively attached to the undercarriage, said turret being capable on unlimited rotation around a substantially vertical axis;

(c) a backhoe operatively attached to said turret;

(d) a trencher operatively mounted to said undercarriage; and (e) means for automatically preventing the backhoe from contacting the trencher.

* * * * *